US006085479A

United States Patent [19]

Carver

[11] Patent Number: 6,085,479

[45] Date of Patent: Jul. 11, 2000

[54] PREMANUFACTURED STRUCTURAL BUILDING PANELS

[76] Inventor: Tommy Lee Carver, 1754 Wildwood Dr., Charlotte, N.C. 28214

[21] Appl. No.: 09/226,883

[22] Filed: Jan. 7, 1999

Related U.S. Application Data

[63] Continuation-in-part of application No. 08/976,734, Nov. 25, 1997, abandoned.

[51] Int. Cl.[7] ..... E04C 1/00

[52] U.S. Cl. ..... 52/309.8; 52/794.1; 52/309.12; 52/309.13; 52/800.12; 52/781.3; 52/404.4; 52/407.3; 52/270; 52/309.7; 52/309.8

[58] Field of Search ..... 52/309.8, 309.9, 52/309.13, 309.14, 800.11, 800.12, 797.1, 781.3, 309.7, 407.3, 404.4, 270, 794.1, 309.12, 731.4, 731.5, 731.8, 731.9, 733.3, 481.1; 428/223, 158, 318.4

[56] References Cited

U.S. PATENT DOCUMENTS

| | | |
|---|---|---|
| Re. 25,364 | 4/1963 | Jacobson . |
| 3,507,738 | 4/1970 | Prusinski et al. . |
| 3,679,529 | 7/1972 | Prusinski et al. . |
| 3,965,633 | 6/1976 | Carroll . |
| 4,063,395 | 12/1977 | Stewart et al. . |
| 4,065,893 | 1/1978 | Epes . |
| 4,154,042 | 5/1979 | Epes . |
| 4,236,361 | 12/1980 | Boden . |
| 4,577,445 | 3/1986 | Price . |
| 4,633,634 | 1/1987 | Nemmer et al. . |
| 4,674,250 | 6/1987 | Altizer . |
| 4,774,794 | 10/1988 | Grieb . |
| 5,048,248 | 9/1991 | Ting . |
| 5,088,259 | 2/1992 | Myers . |
| 5,265,389 | 11/1993 | Mazzone et al. . |
| 5,524,400 | 6/1996 | Schmechel . |
| 5,758,463 | 6/1998 | Mancini, Jr. . |

*Primary Examiner*—Carl D. Friedman
*Assistant Examiner*—Dennis L. Dorsey
*Attorney, Agent, or Firm*—Alston & Bird LLP

[57] ABSTRACT

There is provided a premanufactured structural building panel system for effectively promoting the efficient construction of the exterior wall members of a building having improved insulation, sound absorption, fire retardant and structural properties. The premanufactured structural building panels are made of a pair of C-shaped structural channels. The panels include a fire retarding board secured to opposing angle members and a foam insulation member secured to the fire retarding board. A plurality of retaining members may be provided for additional structural support. The structural panels are supported on wall support members and connected to each other in a side-by-side fashion to form an exterior wall member of a building. The panels are arranged such that the C-shaped channels are protected from conditions external to the building by a portion of the foam insulation members. The exterior wall members include vertical sidewalls, a horizontal roof and ceiling wall, and a pitched roof system. The interior surface of the walls can be prepared for finishing. Affixed to the exterior of the wall members is a weatherable covering.

24 Claims, 7 Drawing Sheets

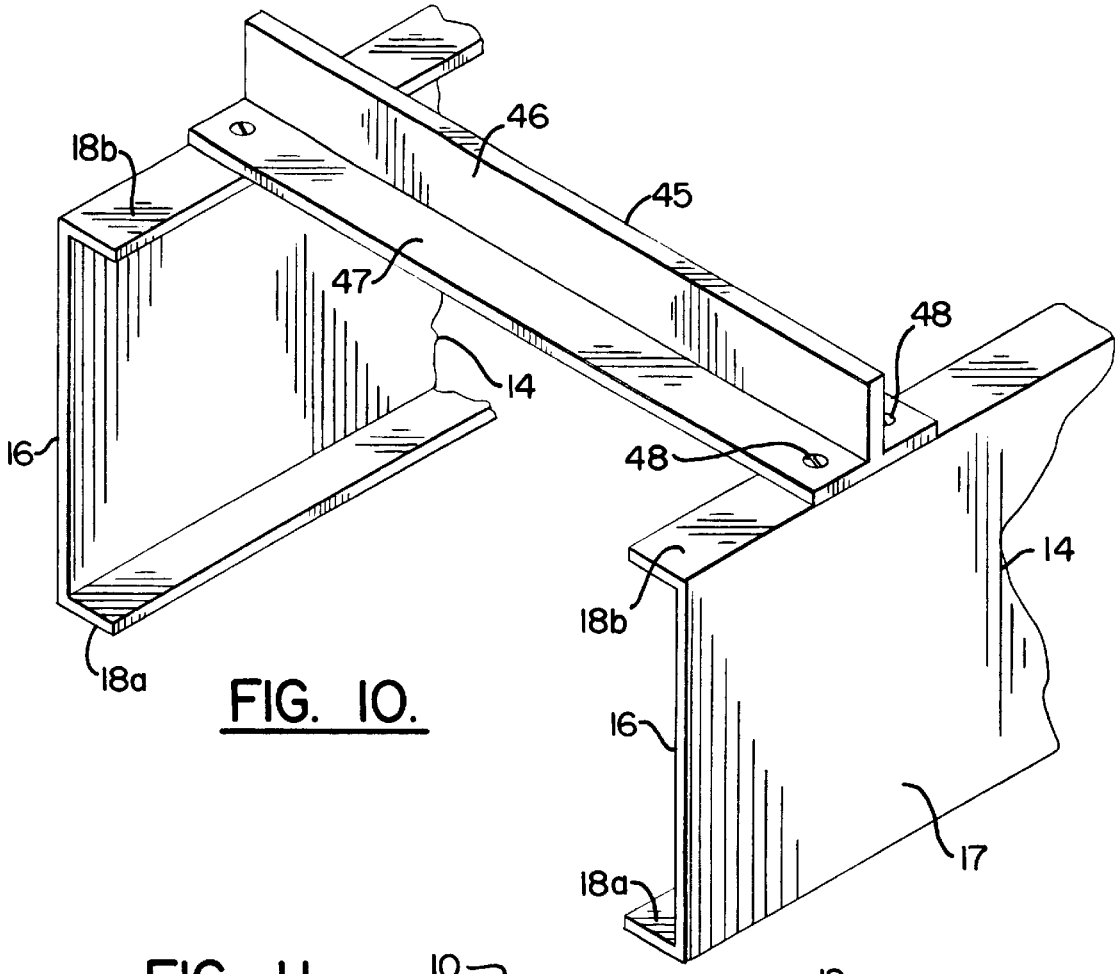
FIG. 10.
FIG. 11.
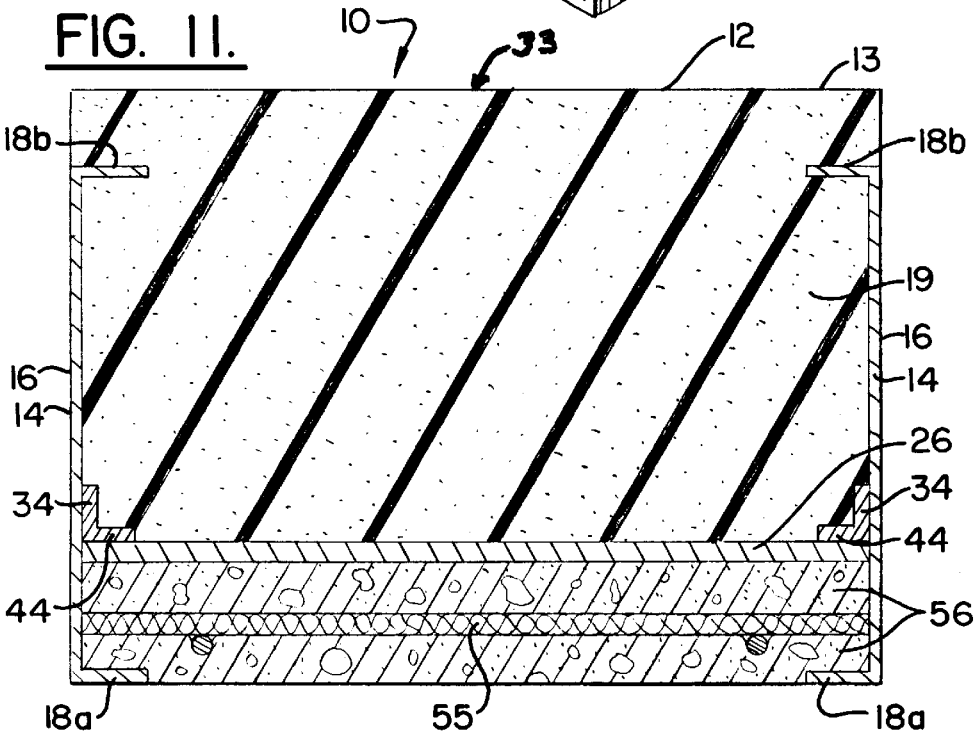

PREMANUFACTURED STRUCTURAL BUILDING PANELS

CROSS-REFERENCES TO RELATED APPLICATIONS

This application is a continuation-in-part of U.S. patent application Ser. No. 08/976,734, filed on Nov. 25, 1997, now abandoned which is hereby incorporated herein in its entirety by reference.

FIELD OF THE INVENTION

The present invention relates to premanufactured structural building panels for the construction of insulated exterior walls. More particularly, the present invention relates to a system of insulated premanufactured structural building panels that can be arranged in a side-by-side fashion to form one or more exterior walls of a building.

BACKGROUND OF THE INVENTION

The floors of conventional commercial and residential buildings are commonly framed using a plurality of horizontally extending structural support beams which are supported on multiple load bearing columns or wood studs. The walls are constructed using uniformly spaced metal or wood studs that extend vertically between the floors of the building.

The roof system of a conventional commercial building includes uniformly spaced joists spanning the length between pairs of parallel support beams. A metal deck is placed on top of the uniformly spaced joists. Panels of insulation board are then layered on top of the deck. The exterior covering of the roof can be formed using a polymer sheeting placed on top of both the deck and the insulation board and secured with ballast or an adhesive.

The roof system of a conventional residential building includes uniformly spaced joists spanning the length between pairs of parallel support beams. Plywood may be placed on top of the uniformly spaced joists. Metal or wood trusses are then erected above the joists to form the framing for the roof. Exterior plywood sheathing is applied on top of the trusses and an exterior covering, such as a roofing felt and either asphalt or wood shingles, is then secured to the exterior surface of the sheathing.

The exposed underside of a conventional commercial or residential roof system is generally not a smooth surface, but instead reveals the exposed joists and deck. Additional materials, such as gypsum coreboard or fiberglass ceiling tiles, in conjunction with a metal grid, can be utilized to form the finished ceiling. In either case, an air space will generally remain between the ceiling and the exposed roof structure. Such ceiling and roof systems can have less than desirable insulation properties and thus additional insulation is often installed. Additionally, conventional ceiling and roof systems have limited sound attenuation and fire retardant properties.

The exterior facade of the building, which may include brick, concrete, stone, metal or wood, is formed adjacent to the studs. Conventional batt insulation is placed between the studs and the interior is then covered with gypsum coreboard to form a smooth surface for finishing. The batt insulation in the wall has a tendency to sag, which can also result in decreased insulation properties and limited sound attenuation, in addition to having limited fire retardant properties.

Accordingly, the construction of conventional sidewalls, ceiling walls and roof systems requires a variety of materials, some of which are quite heavy. The installation of these materials can also be complex and require varying degrees of precision. Thus, installation of these materials is often labor intensive, which can result in higher costs being associated with the construction of these types of buildings.

In seeking better materials for constructing the walls of a building, several forms of premanufactured building panels have been suggested. One such example of a building panel is disclosed in U.S. Pat. No. 5,265,389 to Mazzone, et al. which discloses an exterior curtain wall panel. The panel has a pair of opposed end caps consisting of channels of light gauge galvanized steel and a foam core of expanded polystyrene with a thickness greater than the width of the channels. The structural strength for the panel is provided by multiple open box type tubes extending vertically along the height of the panel and located within the foam core. However, the panel does not provide fire retardation. In addition, the upper and lower channels are exposed to external conditions and the patent discloses that the channels are thus preferably made from rust resistant galvanized steel, which can be expensive if used in all applications.

Another example of a building panel is disclosed in U.S. Pat. No. 5,524,400 to Schmechel which discloses a sidewall assembly for a building. The sidewall assembly includes a plurality of expanded polystyrene panels. Each panel has side and end surfaces which define grooves therein. Each panel has a pair of opposed U-shaped side supports which interface with a corresponding groove extending along one of the longitudinally extending laterally displaced sides of the panel. Adjacent panels are secured together by a pair of opposed U-shaped end supports which interface with corresponding grooves extending along the laterally extending longitudinally displaced ends of the panels and which are secured to the side supports by suitable fasteners. Adjacent panels may also be secured together by joining the abutting side supports with suitable fasteners. However, as with the Mazzone patent, the sidewall assembly disclosed in the Schmechel patent does not provide for fire retardation. In the event of a fire, the expanded polystyrene panels of the sidewall assembly will melt thus removing the internal reinforcement of the U-shaped side and end supports which is necessary to prevent displacement of the supports. In the case of horizontal roof and ceiling panels, which are not disclosed in Schmechel, strength is especially important.

Thus, there is a need for improved building materials for use in the construction of exterior walls, such as sidewalls, ceiling walls and roof systems of buildings. Such materials must be capable of being efficiently installed to reduce labor costs while at the same time providing adequate insulation properties, sound attenuation, fire retardation and structural strength. These materials should also be protected from the weather.

SUMMARY OF THE INVENTION

The present invention provides a premanufactured structural building panel system whereby the structural panels can be constructed inexpensively and efficiently off-site for subsequent installation at the construction site. The individual structural panels are made of a pair of C-shaped structural channels partially encompassing a foam insulation member. The structural panels are connected to each other in a side-by-side fashion to form an exterior wall, including a roof, of a building.

In one embodiment, the premanufactured structural building panels include a pair of structural channels extending longitudinally in parallel directions. Each of the channels is of a generally C-shaped cross section which is defined by a web portion having a laterally outer surface and by first and second flanges connected at opposite ends of the web portion. Where the building panels are used to form a roof and ceiling wall, a plurality of retaining members can be extended between the second flanges of the channels to provide additional structural strength. Each of the channels faces the other such that the flanges extend from the respective web portion in a direction towards the opposing channel.

Advantageously, a fire retarding board extends between the web portions of the channels such that it is adjacent to the first flanges of the channels. The fire retarding board has a surface facing the interior of the building and an opposite exteriorly facing surface.

The structural channels also include third flanges extending from the web portions of each of the channels. The third flanges are located between the first and second flanges and each third flange extends from the respective web portion in a direction towards the other channel. The third flanges are secured to the exteriorly facing surface of the fire retarding board.

A foam insulation member extends between the web portions of the channels. The insulation member has an interiorly facing surface adjacent the exteriorly facing surface of the fire retarding board and an opposite exteriorly facing surface. The insulation member also has a pair of opposite lateral sides each of which defines a groove therein. The second flanges of both channels are engaged within the grooves and are thus protected from the elements.

The structural building panels are connected to wall support members and are arranged in a side-by-side relationship to form an exterior wall member such that the lateral sides of each of the foam insulation members are generally in abutting contact with the corresponding lateral sides of adjacent panels and the laterally outer surface of the web portions of the channels are in abutting contact with and connected to the corresponding laterally outer surface of the web portions of adjacent channels. As such, the present invention advantageously provides an exterior wall member wherein the channels (which are preferably formed of steel) are protected from the elements by the foam members and any rain or moisture impinging on the exterior surface of the exterior wall member will be prevented from coming into contact with the channels. In addition, the fire retarding board and third flanges advantageously provide internal structural support to the channels in the event a fire melts the foam insulation member.

A plurality of adjacent premanufactured structural building panels can be positioned together to form an exterior wall member of a building. The exterior wall members of a building according to the present invention can include vertical sidewalls, a horizontal roof and ceiling wall, or a slanted roof having a predetermined pitch. As such, the entire exterior of a building can be comprised of building panels according to the invention. In contrast to the exterior curtain wall panel of the Mazzone patent and the sidewall assembly of the Schmechel patent, the building panels of the present invention are interchangeable as sidewalls or horizontal roof and ceiling walls since the panels have sufficient fire retardant properties and internal structural strength.

The interior surface of the wall members are prepared for finishing using a finishing board, such as drywall, connected to the first flanges of the channels. The interiorly facing surface of the finishing board has a finishable surface.

A security wall can also be constructed using the building panels of the present invention. The security wall can include a layer of cementitious material retained between the fire retarding board and the first flanges of the channels. Reinforcing members extending between the web portions of the channels may be secured within the layer of cementitious material.

A weatherable covering can be provided on the exterior of the wall members. For the roof and ceiling wall in a commercial building, the covering is made of an elastomeric roof coating placed on the exteriorly facing surface of the foam insulation member. Where the wall member being constructed is a sidewall, the weatherable covering may comprise a weatherable plaster applied directly to the exteriorly facing surface of the foam insulation members. For a roof system in a residential building, the weatherable covering may comprise roof shingles applied to an exterior plywood sheathing. In any event, any water or moisture which is able to get behind the weatherable covering will be precluded from reaching the structural channels by the foam insulation member in the manner discussed above.

At least one sound attenuating board can also advantageously extend between the web portions of the channels. The sound attenuating board has a surface facing the interior of the building and an opposite exteriorly facing surface adjacent the interiorly facing surface of the fire retarding board.

Accordingly, there has been provided a premanufactured structural building panel allowing for the efficient construction of a building in terms of both labor and material costs. The structural building panels further provide fire resistance and an improved insulation value, and can be easily adapted to provide improved sound attenuation. In addition, the panels are generally corrosion resistant once installed.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, and which are not necessarily drawn to scale, wherein:

FIG. 10 is a partial perspective view illustrating another preferred embodiment of the retaining member of a premanufactured structural building panel according to the present invention as used to form a roof system; and FIG. 11 is a plan view illustrating an embodiment of a premanufactured structural building panel according to the present invention as used to form a sidewall having a security barrier.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
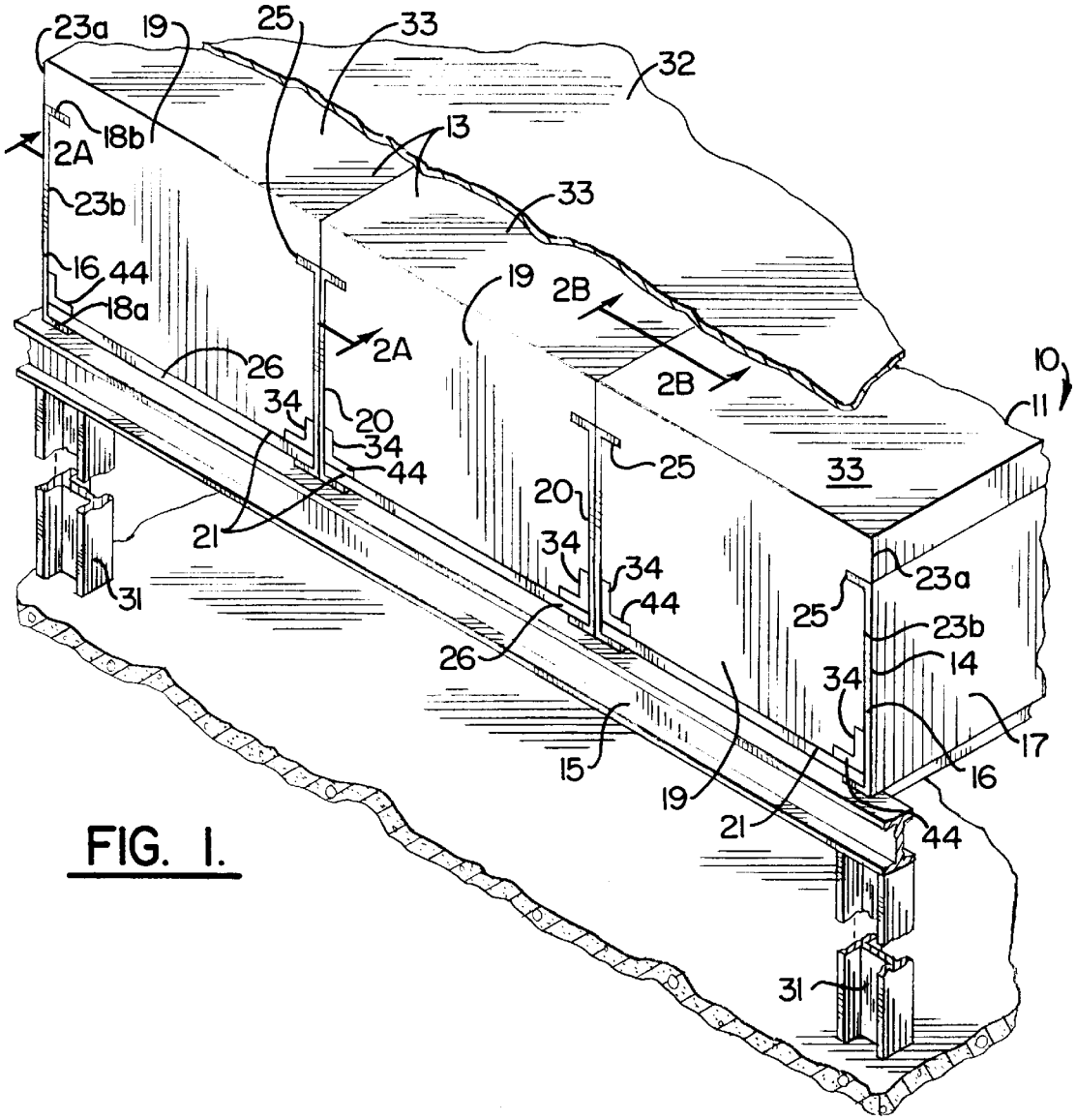
FIG. 1 is a partial perspective view illustrating an embodiment of a premanufactured structural building panel system according to the present invention as used to form a roof and ceiling wall.
Figure 3:
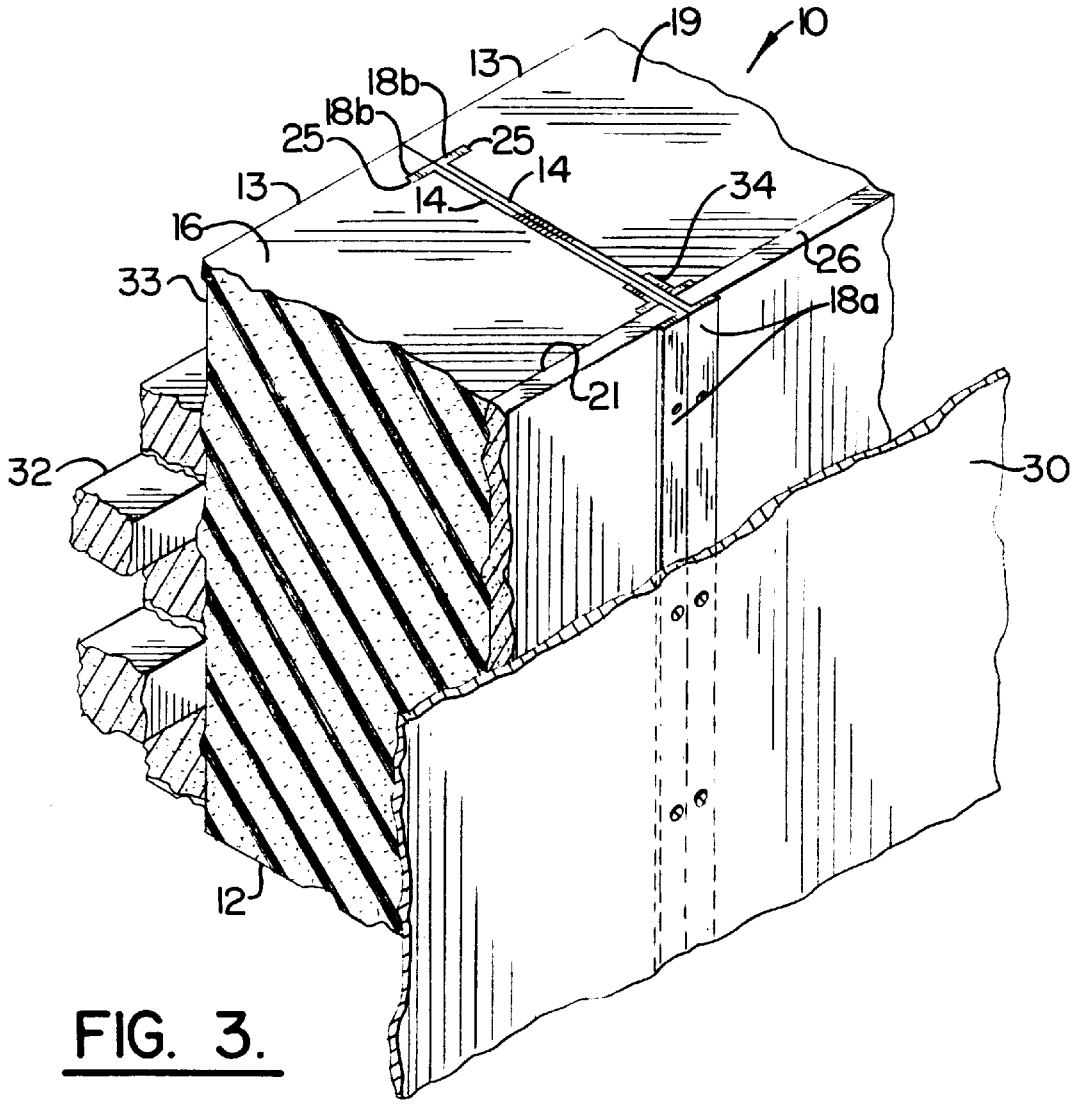
FIG. 3 is a partial perspective view illustrating an embodiment of the premanufactured structural building panel system according to the present invention as used to form an exterior sidewall.

Referring now to the drawings and in particular FIG. 1, there is shown an exterior wall member 10, in this case a horizontal roof and ceiling wall 11, constructed using premanufactured structural building panels 13 according to the present invention. Notably, as shown in FIG. 3, the premanufactured structural building panels 13 can also be used in the construction of vertical sidewalls 12. The interchangeability of the premanufactured structural building panels 13 for use in the construction of either a roof and ceiling wall 11 or a sidewall 12 considerably reduces the number of different materials needed to construct the exterior of a building as compared to conventional wall, roof and ceiling construction.

Figure 2A:
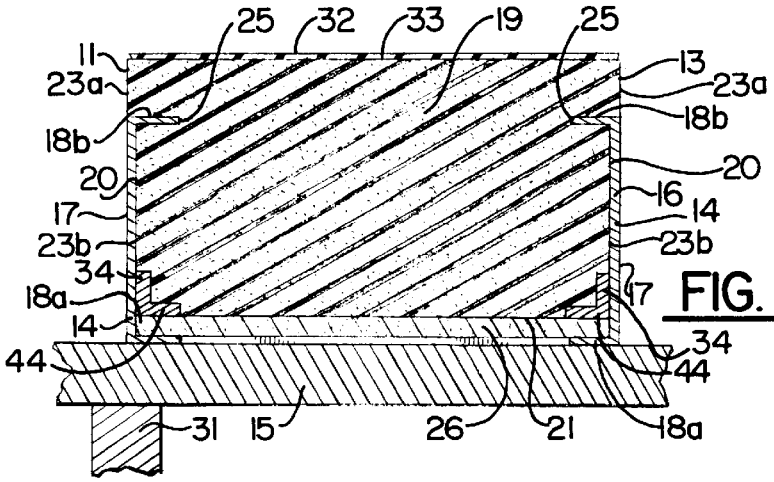
FIG. 2A is a partial cross section of the premanufactured structural building panel system and wall support member of FIG. 1 taken along lines 2A—2A.
Figure 2B:
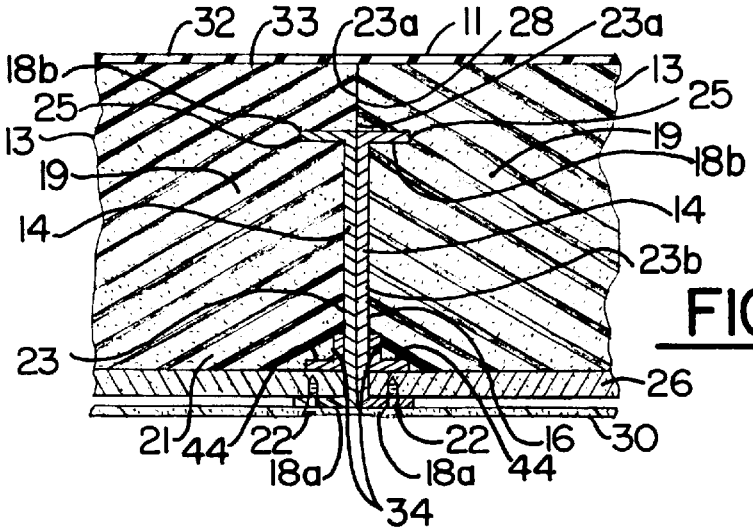
FIG. 2B is a partial cross section of the premanufactured structural building panel system of FIG. 1 taken along lines 2B—2B.

As can be seen in FIGS. 2A and 2B, the structural building panels 13 include a pair of structural channels 14 extending longitudinally in parallel directions and being supported on a wall support members 15. Each of the channels 14 is of a generally C-shaped cross-section which is defined by a web portion 16 having a laterally outer surface 17 and by first and second flanges 18*a,b* extending from opposite ends of the web portion 16 in a direction towards the opposing channel 14.

The channels 14 are advantageously standard steel channels as known in the art. The specifications of the channels 14 are dependent upon the span between wall support members 15 and any specific loading requirements, including wind loads. In a preferred embodiment, channels having a height of 10 inches and formed of 16 gauge steel are used as channels 14 in the construction of structural building panels 13 for horizontal spans of up to 30 feet. The channels 14 used in the construction of structural building panels 13 for installation as a vertical sidewall 12 having a span of up to 25 feet between wall support members 15 are preferably 8 inch, 16 gauge steel channels.

As illustrated in FIG. 1, a pair of angle members 34 having a generally L-shaped cross section defined by two perpendicular arm portions provide third flanges 44 extending from the web portions 16 of each of the channels 14 in a direction towards the other channel. The angle members are preferably formed of steel. The angle members are located between the first and second flanges 18*a,b* and are connected to the web portions 16 of the channels 14 using conventional welding techniques or suitable fasteners. In a preferred embodiment, the angle members 34 are 1.5 inch by 1.5 inch conventional angle iron which will provide additional structural strength to the channels.

As shown in FIG. 1, each panel includes at least one fire retarding board 26 having lateral side edges extending between the web portions 16 of the channels 14 adjacent the first flanges 18*a* of the channels such that the lateral side edges are engaged between the first and third flanges. The fire retarding board has a surface facing the interior of the building and an opposite exteriorly facing surface. The third flanges 44 are secured to the exteriorly facing surface of the fire retarding board by adhesive or suitable fasteners. In a preferred embodiment, the fire retardant board 26 is a one-inch thick panel of gypsum coreboard, but the thickness of the fire board can vary depending on the required fire rating.

For each panel 13, a foam insulation member 19 extends in part between the web portions 16 of the channels 14. The foam insulation members 19 preferably have an interiorly facing surface 21 laminated to the fire retarding board 26 and an exteriorly facing surface 33. The foam insulation member 19 may be formed of expanded polystyrene (EPS) or other suitable lightweight and inexpensive insulation materials. The foam insulation member is preferably installed in segments of approximately 4 to 8 feet. The width and thickness of the foam insulation member 19 will vary depending upon the span between wall support members 15 and any specific loading or insulation requirements.

In a preferred embodiment, the foam insulation member 19 has a width of approximately 2 feet while the thickness of the foam insulation member 19 is varied depending on whether the exterior wall 10 to be constructed is a vertical sidewall 12 or a roof and ceiling wall 11. The thickness of a foam insulation member 19 in a structural building panel 13 for installation as a roof and ceiling wall 11, as shown in FIG. 1, will preferably range from 10 to 12 inches, while the thickness of the foam insulation member 19 for a structural building panel 13 to be installed as a vertical sidewall 12, as shown in FIG. 3, will preferably range from 7 to 8 inches. In either case, the foam insulation members 19 are lighter than conventional materials which can result in reduced labor costs in the construction of the premanufactured structural building panels 13 and later in the installation of the structural panels 13 to form an exterior wall 10.

As shown in FIGS. 2A and 2B, the foam insulation members 19 have a pair of opposite lateral sides 20 which are notched at an adequate distance, preferably about 1–3 inches, from the exteriorly facing surface 33 to form grooves 25. The grooves 25 receive the second flange 18*b* of each channel 14 thus preventing any dewpoint moisture or other exterior ambient weather conditions from contacting the channels 14. The foam insulation members are also notched approximately ⅛ inch along the portion of the lateral sides adjacent to the interiorly facing surface 21 and along the portion of the interiorly facing surface adjacent to the lateral sides to receive the angle members secured to the fire retarding board 26. These notches may be formed by cutting two pieces of foamed material having rectangular cross sections along the length of the foam insulation member or by merely compressing the foamed material with a hammer or the like after the angle members have been positioned.

The opposite lateral sides 20 of the foam insulation members 19 are divided by the grooves 25 into exterior and interior portions 23*a,b*. The thickness of the exterior portions 23*a* is such that the exterior portions 23*a* are generally even with the laterally outer surfaces 17 of the web portions 16 of the respective channels 14, and generally extend in the planes defined by the laterally outer surfaces 17. The channels may be compressed together using a hydraulic press or using a hammer or the like after the channels and second flanges 18*b* have been positioned.

A substantially planar surface is thus created along both of the lateral sides of each of the premanufactured structural building panels 13 which provides a consistent interface along the length of adjacent structural building panels when the structural panels are installed in a side-by-side relationship. This consistent interface assists in preventing the exterior ambient weather conditions from contacting the channels 14. Specifically, any rain or moisture will be prevented from coming into contact with the structural channels 14 because of the intervening and abutting portions of the foam insulation members 19.

Additionally, the foam insulation members 19 advantageously decrease the amount of convective heat transfer compared to conventional insulation, and thus, also provide improved insulation properties.

As shown in FIG. 1, each end of the individual structural building panels 13 is supported on a wall support member 15 that is in turn supported on columns 31. The structural building panels 13 are connected to the support member 15 by steel fastening techniques such as tack welding. The building panels 13 are arranged in a side-by-side relationship to form an exterior wall member 10, in this case a roof and ceiling wall 11. More generally, the entire exterior of a building can be formed using the premanufactured structural building panels 13 according to the invention by constructing four vertical sidewalls 12 and a roof and ceiling wall 11.

In the case of a vertical sidewall 12, the panels can be secured to the foundation and slab (not shown) of the building by forming an L-shaped rim along the length of the foundation. A structural L-channel corresponding to the L-shaped rim can be anchored to the foundation by anchor bolts or other suitable fasteners. The L-channel provides a planar surface for supporting the end of the building panel 13, which end can be secured to the L-channel by welding or suitable fasteners. In the event any water were to penetrate the panel, the L-channel provides a drain for preventing water from entering the building.

Figure 8:
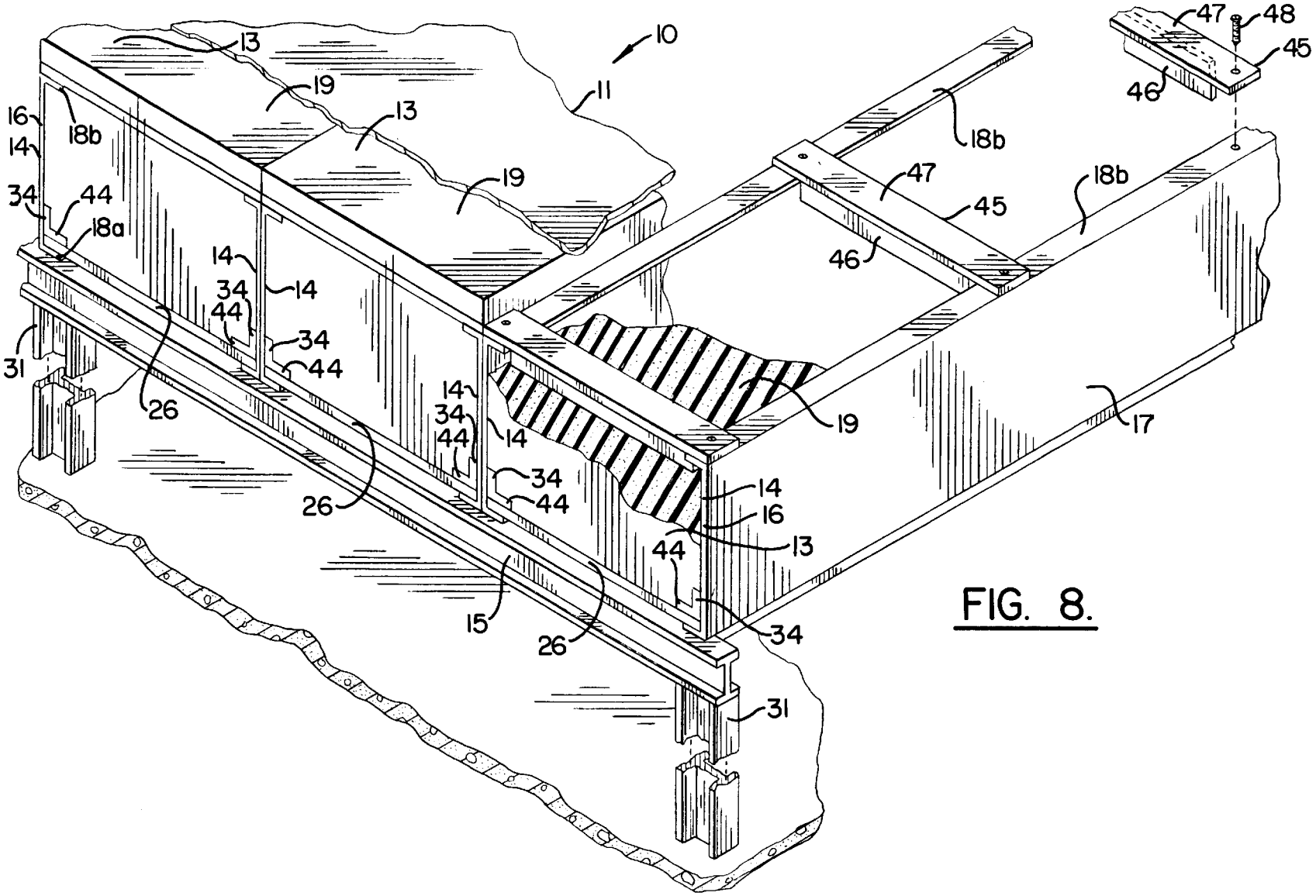
FIG. 8 is a partial perspective view illustrating an embodiment of the premanufactured structural building panel system according to the present invention as used to form a roof system.

As shown in FIG. 8, for a roof and ceiling wall 11, the structural building panels 13 can also include a plurality of retaining members 45 extending between the second flanges 18*b* of the channels 14 approximately every 4 to 8 feet. In a preferred embodiment, each retaining member is generally T-shaped in cross section which is defined by a base portion 46 and a top portion 47. The retaining members are secured to the second flanges of the channels by suitable fasteners 48. In the embodiment shown in FIG. 8, a section of the base portion 46 having a length corresponding to the width of the second flanges 18*b* is removed from each end of the retaining member so that the top portion 47 of the retaining members can be positioned adjacent to the second flanges of the channels. To facilitate securing the retaining members to the second flanges, rectangular portions extending the length of the foam insulation members can be removed and later filled with a foam insulation insert after the retaining members have been secured to the second flanges of the channels. In an alternate embodiment shown in FIG. 10, the retaining member is inverted such that the top portion 47 of the retaining member overlays the second flanges of the channels without necessitating the removal of the ends of the base portion 46 of the retaining members. Preferably, grooves are precut in the foam insulation members to receive the retaining members.

Figure 9:
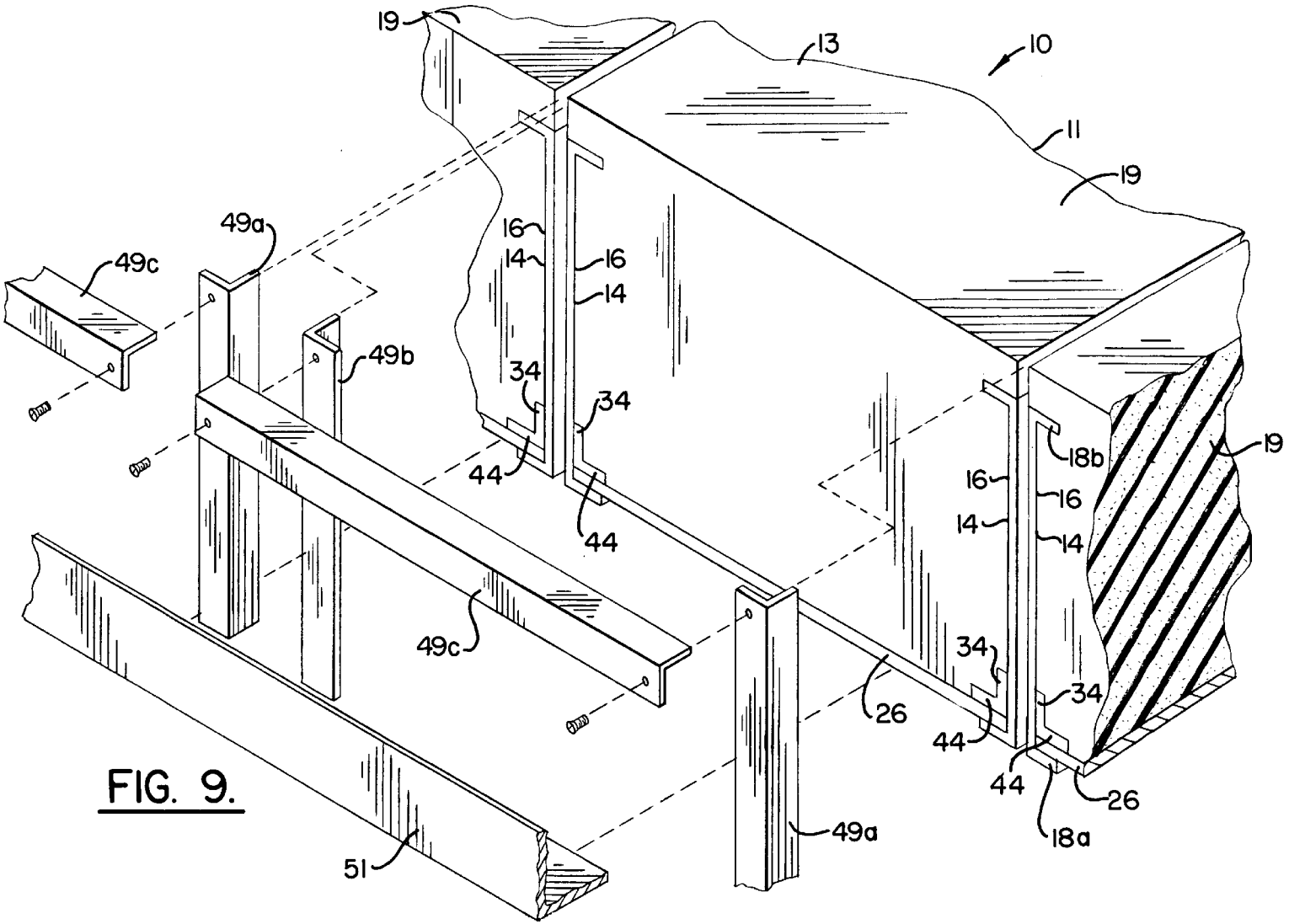
FIG. 9 is a partial exploded view illustrating an embodiment of the premanufactured structural building panel system according to the present invention as used to form a roof system.

As shown in FIG. 9, the structural building panels 13 can also include capping members 49 which have a generally L-shaped cross section. Two of the capping members are preferably positioned such that each capping member 49*a,b* extends between the first and second flanges 18*a,b* of a channel 14. A third capping member 49*c* is then positioned such that it extends between the ends of the first two capping members 49*a,b* adjacent to the second flanges of the channels. The capping members can be secured by suitable fasteners 50 or by tack welding. Preferably, the fire retarding board 26 and the first flanges of the channels are further capped by an L-channel 51, which is secured to abutting building panels after the panels are installed. The L-channels facilitate securing of a vertical sidewall 12 to the roof and ceiling wall 11.

The individual premanufactured structural building panels 13 of the present invention can advantageously be constructed inexpensively and efficiently off-site in a manufacturing facility for later transport to and installation at the construction site. Moreover, since each of the structural panels 13 are made to the same specifications when constructing a particular type of exterior wall member 10, the structural panels facilitate standardized construction. Installation of the individual structural building panels 13 involves arranging the panels such that the exterior portions 23*a* of the opposite lateral sides 20 of the foam insulation members 19 are generally in abutting contact with the corresponding exterior portions 23*a* of adjacent panels. Additionally, the panels 13 are arranged such that the laterally outer surfaces 17 of the web portions 16 of the channels 14 are generally in abutting contact with the corresponding laterally outer surface of the web portions 16 of adjacent channels. The adjacent web portions 16 are then preferably connected to each other by tack welding at predetermined intervals along the interface of the first flanges 18*a* of adjacent channels 14.

As shown in FIGS. 2B and 3, a finishing board 30 can be attached using conventional fasteners to the first flanges 18*a* of the channels 14 to provide a generally smooth surface on the interior of the vertical sidewalls 12 and the underside of the roof and ceiling wall 11. The finishing board 30 can be gypsum board, the interior surface of which can be prepared to receive either paint or wallpaper. Advantageously, the first flange 18*a* of each channel 14 is exposed and thus the structural building panels 13 are ready to receive the finishing board 30 directly on the first flange 18*a* without furring materials. In an alternative embodiment, the finishing board 30 may be omitted because the underside of the structural building panels 13 provides a relatively flat surface which can be prepared to receive paint directly.

A weatherable covering 32 is provided on the exteriorly facing surface 33 of the foam insulation members 19. The composition of the weatherable covering 32 varies depending on whether the exterior wall member 10 being constructed is a roof and ceiling wall 11 or a vertical sidewall 12. FIG. 1 shows the weatherable covering 32 for a roof and ceiling wall 11 which can be made of an elastomeric roof coating placed directly on the exteriorly facing surface 33 of the foam insulation member 19. The elastomeric skin can be white in color to increase light reflection and decrease heat absorption from the sun. Advantageously, the weatherable covering 32 for a roof and ceiling wall 11 will not require a ballast as in conventional roof systems, which can increase labor cost for installation and repair. As shown in FIG. 3, in situations where the exterior wall member 10 being constructed is a vertical sidewall 12, the weatherable covering 32 may comprise brick, stucco and aluminum, vinyl or clapboard siding, or preferably, weatherable plaster with a color aggregate for aesthetic variations.

Figure 4:
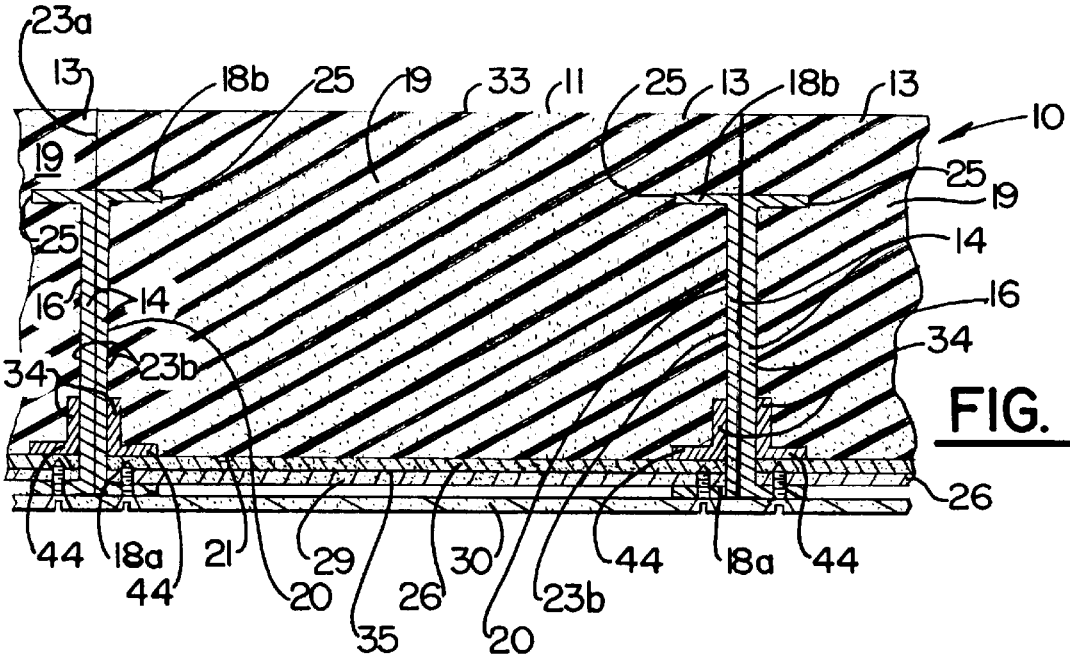
FIG. 4 is a plan view illustrating an alternate embodiment of a premanufactured structural building panel.

FIG. 4 shows an alternate embodiment of the premanufactured structural building panels in which a sound attenuating board 29 advantageously extends between the web portions 16 of the channels 14. The sound attenuating board 29 has a surface facing the interior of the building and an opposite exteriorly facing surface 35 which is preferably laminated to the fire retardant board 20. Preferably, the sound attenuating board 29 is a one inch thick panel of tectum fiber board.

As shown in FIG. 11, a security wall can be constructed using the building panels 13 of the present invention. In a preferred embodiment, the structural building panels used to form a sidewall 12 are constructed as described above, except that the thickness of the foam insulation members 19 is reduced over a section of the panels by approximately 1 to 2 inches. Preferably, the section of the panels, which corresponds to the height of the security wall, is approximately 8 feet in length. Once each building panel is constructed, the panel is positioned such that the exteriorly facing surface 33 of the foam insulation member is facing downward (upside down relative to FIG. 11). Advantageously, the reduction in thickness of the foam insulation member forms a cavity having a bottom defined by the fire retarding board 26, sides defined by the web portions 16 of the channels 14, and a partial top surface defined by the first flanges 18*a* of the channels. Reinforcing members 55 can be positioned within the cavity between the fire retarding board and the first flanges of the channels by tack welding such that the reinforcing members extend between the web portions of the channels. The reinforcing members are preferably #3 or #4 reinforcing bar. A layer of substantially liquid cementitious material 56, such as lightweight concrete, can then be poured over the reinforcing members such that the liquid cementitious material fills the cavity between the fire retarding board and the first flanges of the channels. Formwork can be applied to the end of the building panel to maintain the cementitious material within the cavity. Once dry, the cementitious material will form a solid security layer or barrier retained between the fire retarding board and the first flanges of the channels. The building panels can then be installed to form a sidewall having a security wall of predetermined height. In an alternate embodiment, the fire retarding board and angle members may be omitted when forming the security wall such that the foam insulation member directly abuts the cementitious layer. In another alternate embodiment (not shown), the security wall can be constructed of flattened expanded metal sheets.

Figure 5:
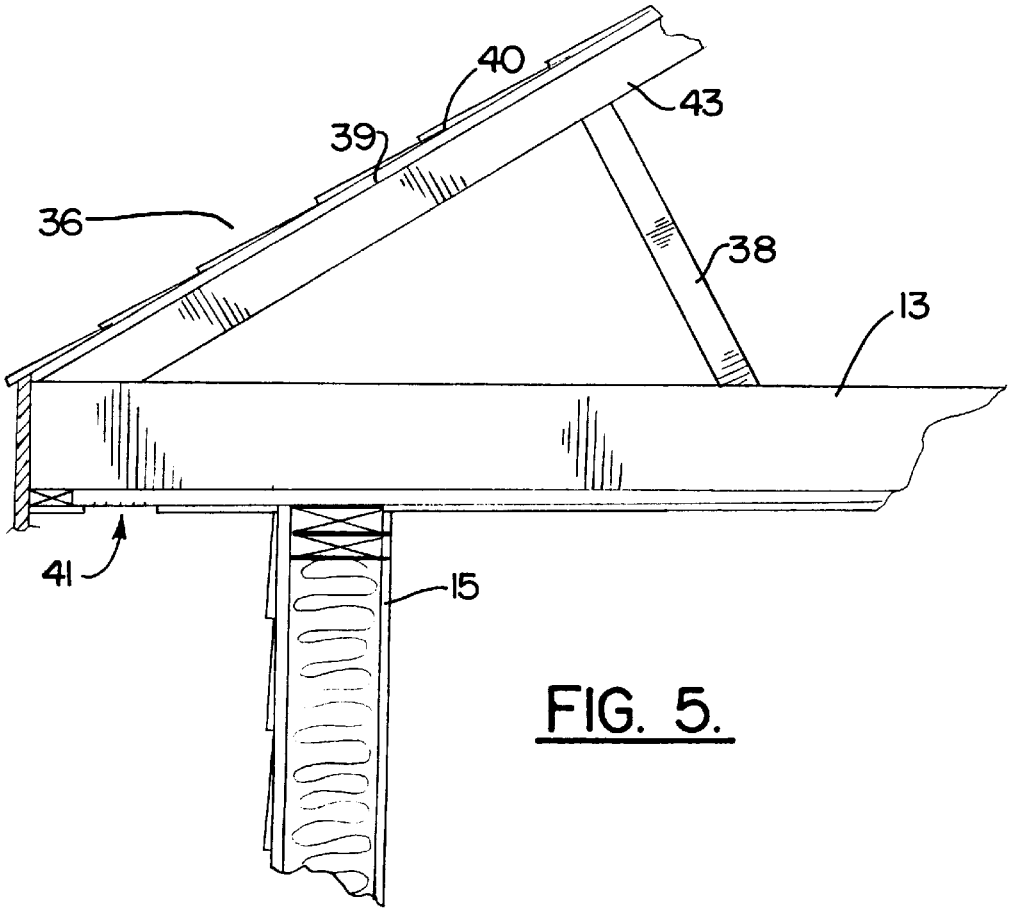
FIG. 5 is a plan view illustrating an embodiment of a premanufactured structural building panel system according to the present invention as used to form a residential roof system.
Figure 6:
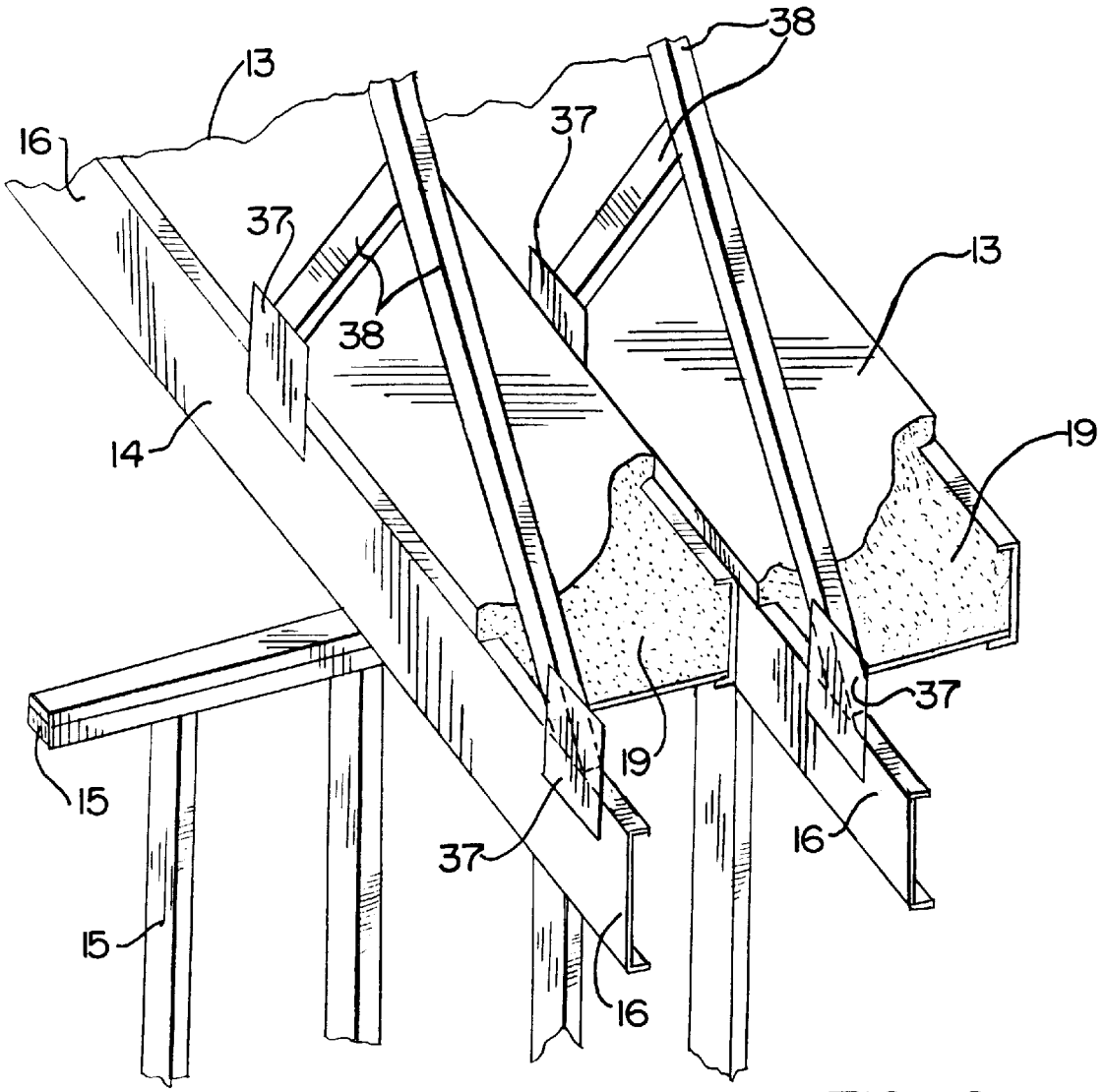
FIG. 6 is a partial perspective view illustrating an embodiment of a premanufactured structural building panel according to the present invention as used to form a residential roof system.

As shown in FIGS. 5 and 6, the premanufactured structural building panels 13 can also be used in the construction of a residential roof system 36. Such a roof system 36 can be used to span distances of 40–65 feet, with typical spans being from 30–32 feet. As before, the premanufactured structural building panels 13 extend between wall support members 15, preferably being positioned 2 feet on-center. The wall support members 15 also form the bearing wall for the roof trusses. The premanufactured structural building panels 13 include metal tabs 37, preferably of 14 gauge steel, attached to the web portions 16 of one or both of the structural channels 14 at predetermined points along the length of the premanufactured structural building panels 13. Above the premanufactured structural building panels 13, metal or wood truss members 38, 43 or alternatively, rafters and jack studs (not shown), are erected to support the exterior plywood sheathing 39 and weatherable covering 40. The truss members 38 or jack studs (not shown) are attached to the metal tabs 37 which act as truss point connections to provide structural support for the roof system 36. In addition, at least one of the two structural channels 14 of each of the premanufactured structural building panels 13 extends beyond the termination of the foam insulation member 19 and is connected to a jack stud or truss member 38 in order to provide additional support for the roof system 36. The overhanging structural channel 14 can later be used to construct a vented soffit 41 around the exterior of the building.

Figure 7:
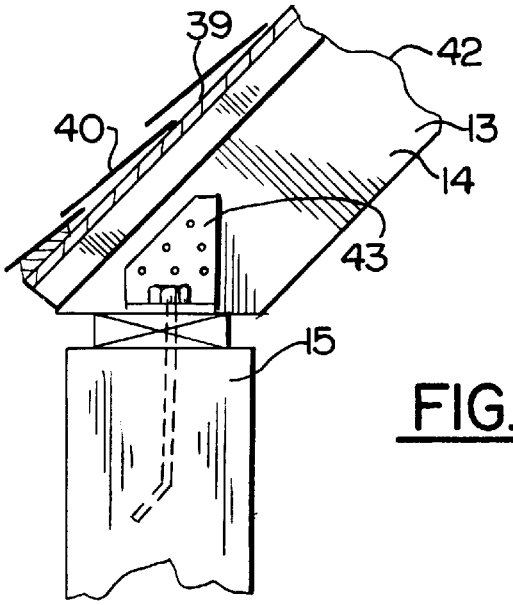
FIG. 7 is a plan view illustrating a premanufactured structural truss panel attached to a wall support member.

The premanufactured structural building panels 13 can also be used as premanufactured structural truss panels 42 in a slanted roof for forming cathedral-type ceilings. The premanufactured structural truss panels 42 are supported at a predetermined roof pitch by a wood or metal center beam (not shown) which extends along the apex of the roof. Where the premanufactured structural truss panels 42 intersect the wall support members 15, one or both of the structural channels 14 of each of the premanufactured structural truss panels is preferably attached to the wall support member through a metal joist panel 43 or angle iron (not shown) which provides additional support for the roof system 36. As illustrated in FIG. 7, the end of the premanufactured structural truss panel 42 is connected to the wall support member 15. However, the premanufactured structural truss panel may also extend past the wall support member 15 to form an overhang (not shown). In such an embodiment, the metal joist panel 43 attaches to the premanufactured structural truss panel along the length of the panel, at the intersection of the panel and the wall support member, rather than at the end of the truss panel.

Sub-purlins (not shown) can be attached to the exteriorly facing surface of the premanufactured structural truss panels 42 in order to create an air space between the exteriorly facing surface and the weatherable covering 40. Exterior plywood sheathing 38 can then be attached to the sub-purlins. A weatherable covering 40 is then secured to the exterior surface of the sheathing 39. Preferably, the weatherable covering 40 will include a roofing felt and roof shingles, such as asphalt or wood shingles.

Use of the premanufactured structural building panels 13 in residential roof systems 36 provides several advantages. The structural channels 14 of the roof system 36 are protected from any water or moisture which is able to get behind the weatherable covering 40 by the foam insulation members 19. Moreover, the foam insulation members 19 provide an improved insulation value over conventional blown fiberglass or batt insulation by further restricting convective heat transfer.

In the drawings and the specification, there has been set forth preferred embodiments of the invention and, although specific terms are employed, the terms are used in a generic and descriptive sense only and not for purpose of limitation, the scope of the invention being set forth in the following claims.

What is claimed is:

1. An insulated building comprising:

a plurality of wall support members;

a plurality of wall members supported by said wall support members, each of said wall members formed from a plurality of premanufactured structural building panels each comprising;

a pair of parallel structural channels extending longitudinally between said support members, each of said channels having a generally C-shaped cross section defined by a web portion having a laterally outer surface defining a plane and by first and second flanges connected at opposite ends of said web portion, each of said flanges extending from the respective web portion in a direction towards the other of said channels;

third flanges extending from said web portions of each of said channels between said first and second flanges, each of said third flanges extending from the respective web portion in a direction towards the other of said channels;

at least one fire retarding board having lateral side edges extending between said web portions of said channels adjacent said first flanges of said channels such that said lateral side edges are engaged between said first and third flanges, said at least one fire retarding board having a surface facing the interior of the building and an opposite exteriorly facing surface;

a foam insulation member extending between said web portions of said channels and having an interiorly facing surface adjacent said at least one fire retarding board and an opposite exteriorly facing surface, said foam insulation member further having a pair of opposite lateral sides each defining a groove therein in which said second flanges of said channels are engaged; and each of said building panels being connected to said wall support members and arranged in a side-by-side relationship such that at least one of the exterior portions of said opposite lateral sides of said foam insulation member of each panel is in abutting contact with the corresponding exterior portion of an adjacent panel.

2. A building as defined in claim 1 wherein the laterally outer surface of at least one of said web portions of said channels is in abutting contact with and connected to the corresponding laterally outer surface of the web portion of an adjacent channel.

3. A building as defined in claim 1 wherein said building panels further comprise:

a cementitious layer extending between at least a portion of said web portions of said channels, said cementitious layer being retained between said at least one fire retarding board and said first flanges of said channels; and a plurality of reinforcing members secured within said cementitious layer such that said cementitious layer and said plurality of reinforcing members form a security barrier.

4. A building panel as defined in claim 1 wherein said building panels further comprise at least one sound attenuating board extending between said web portions of said channels and having a surface facing the interior of the building and an opposite exteriorly facing surface adjacent said at least one fire retarding board.

5. A building as defined in claim 1 wherein at least one of said wall members includes a weatherable outer covering.

6. A building as defined in claim 5 wherein one of said wall members is covered with weatherable plaster.

7. A building as defined in claim 5 wherein one of said wall members is covered with an elastomeric skin.

8. A building as defined in claim 5 wherein one of said wall members is covered with roof shingles.

9. A building as defined in claim 1 further comprising a plurality of retaining members extending between said second flanges of said channels.

10. A premanufactured structural building panel for forming an insulated sidewall member of a building, said panel comprising:

a pair of structural channels extending longitudinally in parallel directions, each of said channels having a generally C-shaped cross section defined by a web portion and by first and second flanges connected at opposite ends of said web portion, each of said flanges extending from the respective web portion in a direction towards the other of said channels;

third flanges extending from said web portions of each of said channels between said first and second flanges, each of said third flanges extending from the respective web portion in a direction towards the other of said channels;

at least one fire retarding board having lateral side edges extending between said web portions of said channels adjacent said first flanges of said channels such that said lateral side edges are engaged between said first and third flanges, said at least one fire retarding board having a surface facing the interior of the building and an opposite exteriorly facing surface; and a foam insulation member extending between said web portions of said channels and having an interiorly facing surface adjacent said exteriorly facing surface of said fire retarding board and an opposite exteriorly facing surface, said foam insulation member further having a pair of opposite lateral sides each defining a pair of grooves therein in which said second flanges of said channels are engaged.

11. A building as defined in claim 10 wherein said building panels further comprise:

a cementitious layer extending between at least a portion of said web portions of said channels, said cementitious layer being retained between said at least one fire retarding board and said first flanges of said channels; and a plurality of reinforcing members secured within said cementitious layer such that said cementitious layer and said plurality of reinforcing members form a security barrier.

12. A building panel as defined in claim 10 further comprising at least one sound attenuating board having lateral side edges extending between said web portions of said channels and having a surface facing the interior of the building and an opposite exteriorly facing surface adjacent said at least one fire retarding board.

13. A building panel as defined in claim 10 wherein said fire retarding board comprises gypsum coreboard.

14. A building panel as defined in claim 10 wherein said foam insulation member comprises expanded polystyrene.

15. A premanufactured structural building panel for forming an insulated ceiling and roof wall member of a building said panel comprising:

a pair of structural channels extending longitudinally in parallel directions, each of said channels having a generally C-shaped cross section defined by a web portion and first and second flanges connected at opposite ends of said web portion, each of said flanges extending from the respective web portion in a direction towards the other of said channels;

third flanges extending from said web portions of each of said channels between said first and second flanges, each of said third flanges extending from the respective web portion in a direction towards the other of said channels;

at least one fire retarding board having lateral side edges extending between said web portions of said channels adjacent said first flanges of said channels such that said lateral side edges are engaged between said first and third flanges, said at least one fire retarding board having a surface facing the interior of the building and an opposite exteriorly facing surface;

a plurality of retaining members extending between said second flanges of said channels; and a foam insulation member extending between said web portions of said channels and having an interiorly facing surface adjacent said exteriorly facing surface of said fire retarding board and an opposite exteriorly facing surface, said foam insulation member further having a pair of opposite lateral sides defining a pair of grooves in which said second flanges of said channels are engaged such that said second flanges are protected from conditions external to the building.

16. A building panel as defined in claim 15 further comprising at least one sound attenuating board having lateral side edges extending between said web portions of said channels and having a surface facing the interior of the building and an opposite exteriorly facing surface adjacent said at least one fire retarding board.

17. A building panel as defined in claim 15 wherein said fire retarding board comprises gypsum coreboard.

18. A building panel as defined in claim 15 wherein said foam insulation member comprises expanded polystyrene.

19. A method of manufacturing an insulated structural building panel comprising the steps of:

securing a pair of longitudinally extending angle members along opposite edges of the first side of a fire retarding board, the angle members having a generally L-shaped cross section defined by two perpendicular arm portions, the angle members being secured to the fire retarding board such that one of the arm portions of each of the angle members extends in a direction towards the other of the angle members;

securing a foam insulation member to the first surface of the fire retarding board, the foam insulation member having an interiorly facing surface adjacent the first side of the fire retarding board and an opposite exteriorly facing surface, the foam insulation member further having a pair of opposite lateral sides defining a pair of grooves therein;

positioning a pair of longitudinally extending structural channels parallel to one another, each of the channels having a generally C-shaped cross section defined by a web portion having a laterally outer surface defining a plane and by first and second flanges connected at opposite ends of the web portion, the channels being positioned such that each of the flanges extends from the respective web portion in a direction towards the other of the channels;

placing the at least one fire retarding board, the pair of angle members and the foam insulation member between the web portions of the channels such that the fire retarding board and the foam insulation member extend between the web portions and the second side of the fire retarding board is adjacent to the first flanges of the channels;

inserting the second flanges of the channels in the grooves defined in the opposite lateral sides of the foam insulation member.

20. A method of manufacturing a structural building panel as defined in claim 19 further comprising the step of:

securing at least one sound attenuating board to the interiorly facing surface of the fire retarding board; and placing the at least one fire retarding board, sound attenuating board, the pair of angle members and the foam insulation member between the web portions of the channels such that the fire retarding board, sound attenuating board and the foam insulation member extend between the web portions and the sound attenuating board is adjacent to the first flanges of the channels.

21. A method of manufacturing a structural building panel as defined in claim 19 further comprising the step of securing a plurality of retaining members between the second flanges of the channels.

22. A method of manufacturing a structural building panel as defined in claim 19 further comprising the steps of:

positioning a retaining member such that it extends between the second flanges of the channels;

securing the retaining member to the second flanges of the channels; and inserting portions of foam insulation to cover the ends of the retaining members.

23. A method of manufacturing an insulated structural building panel having a security barrier comprising the steps of:

positioning a pair of longitudinally extending structural channels parallel to one another, each of the channels having a generally C-shaped cross section defined by a web portion having a laterally outer surface defining a plane and by first and second flanges connected at opposite ends of the web portion, the channels being positioned such that each of the flanges extends from the respective web portion in a direction towards the other of the channels;

placing a foam insulation member having a pair of opposite lateral sides defining a pair of grooves therein between the web portions of the channels;

inserting the second flanges of the channels in the grooves defined in the opposite lateral sides of the foam insulation member;

positioning a plurality of reinforcing members between the foam insulation member and the first flanges of the channels such that the reinforcing members extend between the web portions of the channels;

pouring a substantially liquid cementitious material over the reinforcing members such that the liquid cementitious material fills the cavity between the foam insulation member and the first flanges of the channels; and allowing the cementitious material to dry and harden such that the cementitious material is retained between the foam insulation member and the first flanges of the channels.

24. A method of manufacturing a structural building panel as defined in claim 23 further comprising the steps of:

securing a pair of longitudinally extending angle members along opposite edges of the first side of a fire retarding board, the angle members having a generally L-shaped cross section defined by two perpendicular arm portions, the angle members being secured to the fire retarding board such that one of the arm portions of each of the angle members extends in a direction towards the other of the angle members;

securing the foam insulation member to the first surface of the fire retarding board; and placing the fire retarding board, the pair of angle members and the foam insulation member between the web portions of the channels such that the fire retarding board and the foam insulation member extend between the web portions.

* * * * *